US006774712B2

(12) United States Patent
Rhee et al.

(10) Patent No.: US 6,774,712 B2
(45) Date of Patent: Aug. 10, 2004

(54) INTERNAL VOLTAGE SOURCE GENERATOR IN SEMICONDUCTOR MEMORY DEVICE

(75) Inventors: Sang-Jae Rhee, Sungnam (KR); Jae-Yoon Sim, Suwon (KR); Sang-Pyo Hong, Seoul (KR); Ki-Chul Chun, Yongun (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/331,602

(22) Filed: Dec. 31, 2002

(65) Prior Publication Data

US 2004/0004513 A1 Jan. 8, 2004

(30) Foreign Application Priority Data

Jul. 8, 2002 (KR) ..... 2002-39387

(51) Int. Cl.[7] ..... G05F 1/10

(52) U.S. Cl. ..... 327/540

(58) Field of Search ..... 327/530, 534, 327/535, 537, 538, 540, 541

(56) References Cited

U.S. PATENT DOCUMENTS

| | | | | |
|---|---|---|---|---|
| 5,689,469 A | | 11/1997 | Asaka et al. | |
| 6,081,459 A | * | 6/2000 | Kim | 365/189.09 |
| 6,084,386 A | | 7/2000 | Takahashi et al. | |
| 6,097,113 A | * | 8/2000 | Teraoka et al. | 307/125 |
| 6,275,100 B1 | | 8/2001 | Park et al. | |

* cited by examiner

*Primary Examiner*—Jeffrey Zweizig
(74) *Attorney, Agent, or Firm*—Harness, Dickey & Pierce, P.L.C.

(57) ABSTRACT

In this circuit, an external voltage source is supplied or down converted in response to a normal operating mode to provide the internal voltage source of a first level to the internal circuit. The external voltage source is converted to a voltage of a second level, lower than the first level, in response to a low consumption power mode having a complementary relation with the normal mode.

24 Claims, 4 Drawing Sheets

INTERNAL VOLTAGE SOURCE GENERATOR IN SEMICONDUCTOR MEMORY DEVICE

BACKGROUND OF THE INVENTION

1. Field of the Invention

The present invention relates to a circuit for generating a voltage source in a semiconductor memory device.

2. Prior Art of the Invention

A rapid development in an electronic/communication industry brings about an appearance of handheld terminals having a multimedia function or an improved multimedia function. For instances, a handheld phone employing a code division multiple access-2000 system, a post PC, a handheld PC and a personal digital assistant (PDA) etc. have a DRAM built-in capable of processing a large capacity according to an increased requirement concerning a function of multimedia. Such handheld terminals have a supply of an operating voltage source from a battery, thus a battery saving is being on the rise as an important issue. Further, according that a size of such handheld terminals is getting miniaturized more and more, it is a tendency that a size and a capacity of the battery built-in are getting miniaturized. Therefore, a technique for saving electric power is being improved gradually. Accordingly, a work-use memory used in utilizing the handheld terminal, for example, a DRAM requires a high-speed/low consumption electric power and a large capacity. One of the most importance elements in using the DRAM in the handheld terminal is how to minimize current consumption of a DRAM.

To minimize the power consumption in a semiconductor memory device, an internal voltage source generating circuit is used for converting a voltage source supplied from the outside and for providing it to an internal circuit of a chip. In such an internal voltage source generating circuit and according to its construction, a level of external voltage source supplied from the outside of the chip is utilized so as to generate a reference voltage ("Vref"). Vref is then utilized to generate the internal voltage source ("IVC"). The IVC has a level necessary for respective circuits of the chip inside; for instances, peripheral circuits of a memory device and a memory array, etc. Such an IVC generating circuit is also called an Internal Voltage down Converter. An IVC generating circuit is useful in supplying a constant voltage source, changed from an external voltage source based on a wide range, to the inside of the chip. An example of such technique is described in detail in "Internal Voltage Source Generating Circuit and Semiconductor Memory Device therefore" (Hereinafter, "the Prior Patent") which was filed, and was registered on Jun. 28, 2000 by the present Applicant.

The Prior Patent provides an internal voltage source generating circuit for supplying a power source to a data output buffer, requiring a voltage source generating circuit in the normal operating mode. Support of other operating modes may be required. For example, support for an operation of a Deep Power Down Mode ("DPD") mode standardized in Joint Electron Device Engineering Council ("JEDEC"), to minimize power consumption in a semiconductor memory device. As is well-known in the art, the DPD mode minimizes a level of voltage source supplied to respective circuits provided within the DRAM, so as to become about 1 $\mu$A and below in power consumption when a system having a mounting of a memory does not use the DRAM. In other words, in this mode, there is no need to continuously maintain data stored in the DRAM.

A reference voltage generating circuit used in another semiconductor memory device was disclosed in U.S. Pat. No. 6,275,100 (hereinafter, "the Second Prior Patent"), patented by the present Applicant. The reference voltage generator disclosed in the second Prior Patent had at least one switch for switching a power source supply path between an input terminal of an external voltage source ("EVC") and a power source input terminal of the reference voltage generator in response to a standby signal, provided from the outside of the semiconductor memory device. In such second Prior Patent, an operation of the DPD mode was not supported, since the EVC supplied to the reference voltage generator of a chip, from the outside of the chip, was completely cut off.

SUMMARY OF THE INVENTION

The present invention resolves the shortcomings of the prior art by implementing an internal voltage source generating circuit, which is operable to convert the voltage of an external voltage source to at least a first and a second voltage level. These levels are normally exclusive to one another and are meant to operate a semiconductor memory device which is capable of at least a first and second operating mode. In one exemplary embodiment, the at least first and second operating modes will respectfully coincide with the at least first and second voltage levels. Thus, the voltage level will depend on the operating mode of the semiconductor memory device. Other embodiments will be designed such that the first voltage level is a "normal" operating voltage level for the semiconductor memory device and the second voltage level is one that will support the Deep Power Down mode.

BRIEF DESCRIPTION OF THE DRAWINGS

The above and other objects and features of the instant invention will become apparent from the following description of preferred embodiments taken in conjunction with the accompanying drawings, in which.

PREFERRED EMBODIMENT OF THE INVENTION

Figure 1:
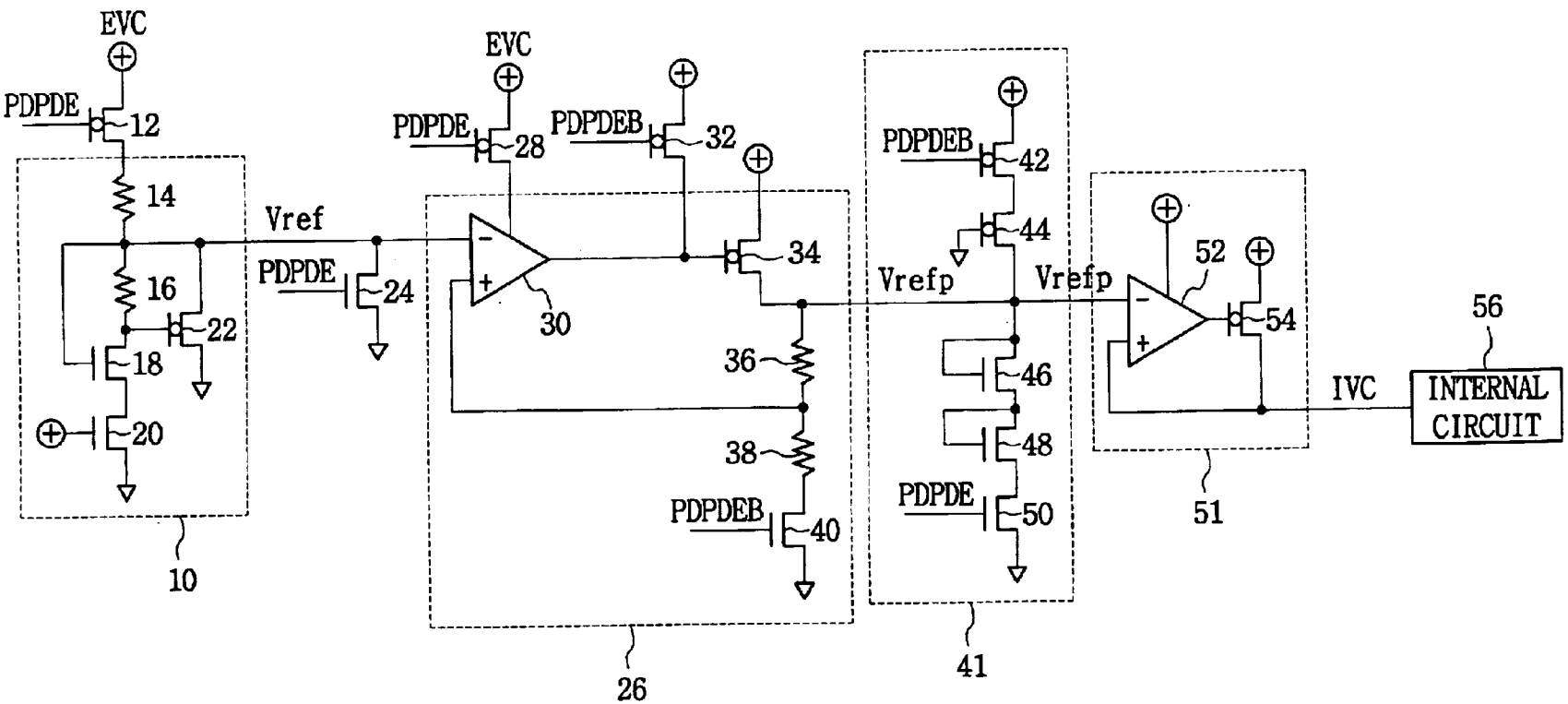
FIG. 1 indicates a circuit diagram of a circuit for generating internal voltage source in a semiconductor memory device according to a first exemplary embodiment of the present invention.

Hereinafter, preferred embodiments of the present invention will be described in detail with reference to the accompanying drawings.

It should be understood that the present invention can be embodied in numerous embodiments and is not limited by the following described embodiments. The following various embodiments are provided for an explanation only and only to sufficiently transfer the inventive thought to those skilled in the art. It will be noted that a detailed description for a well-known function and construction can be omitted, and that constructive elements having the same function are represented by the same reference characters and numbers in the following description.

In accordance with the present invention, FIG. 1 is an exemplary embodiment of a circuit for generating an internal voltage source ("IVC") in a semiconductor memory device that reduces current consumption of a chip when the device is in a DPD operating mode. Minimizing the current is performed by providing a different voltage level IVC to an internal circuit 56 when the internal circuit 56 is in a normal operating mode than when in the DPD mode. Such operating modes are determined by a control command input from outside the chip or by a transition of voltage level at a specific pin of the chip. It should be understood by those skilled in the art that a first and second mode, and their respective voltages, are a minimum.

When the circuit for generating IVC shown in FIG. 1, is operating in the first operating mode, typically the normal operating mode, a control signal PDPDE is activated as "low" and a complementary control signal PDPDEB becomes "high". Therefore, the P-type MOS transistors 12, 28 and an NMOS transistor 40 are turned On, while the PMOS transistors 32, 42 and an NMOS transistor 50 are turned Off.

The PMOS transistor 12 is turned on in the first operating mode, and an external voltage source ("EVC") supplied from the chip outside is inputted to a reference voltage generator 10 through the PMOS transistor 12. This reference voltage generator 10 includes two resistances 14, 16 and two NMOS transistors 18, 20 connected in series between a drain of the PMOS transistor 12 and a ground. A temperature complementary-type PMOS transistor 22 has a source and gate respectively connected to the ends of the resistance 16 and a drain that is grounded. A gate of the NMOS transistor 18 is connected to a source of the PMOS transistor 22, and a gate of the NMOS transistor 20 is connected to EVC. The reference voltage generator 10 shown in FIG. 1 generates reference voltage ("Vref") based on a constant level which is decided by a size of two resistances 14, 15 connected in series with each other and by a size of the NMOS transistors 18, 20. The reference voltage generator 10 sends Vref to a peripheral circuit reference voltage generator 26, when the reference voltage generator 10 is in the first operating mode; thus the PMOS transistor 12 is a turn-on state. The reference voltage generator 10 includes a voltage divider.

A differential amplifier 30 within the peripheral circuit reference voltage generator 26 is operated by the EVC supplied from a drain of the PMOS transistor 28. The differential amplifier 30 amplifies a voltage difference input through an inverting input terminal and a non-inverting input terminal, and provides the difference to a gate of a PMOS transistor 34, connected to the differential amplifier 30 output terminal. The PMOS transistor 34 is a driver, and the PMOS transistor 34's source is connected to the external voltage source EVC, and the PMOS transistor 34's drain is connected with two resistances 36, 38 and a drain of an NMOS transistor 40 in series. A connection node of two serial resistances 36, 38 is connected to the non-inverting input terminal of the differential amplifier 30, a source of the NMOS transistor 40 is grounded, and a gate of the NMOS transistor 40 is connected to the complementary control signal PDPDEB. In such configuration the peripheral circuit reference voltage generator 26 has an active response when the control signal PDPDE is a logic "low"; wherein the peripheral circuit reference voltage generator 26 has an output of Vref as a peripheral circuit reference voltage ("Vrefp") of a given level. Vrefp is obtained by the following numerical equation 1, $$Vrefp=(1+R36/R38)Vref \quad (1)$$

wherein R36 and R38 represent each value of the resistances 36 and 38.

Vrefp, generated as shown in the Numerical Equation 1, is sent to an inverting input terminal of a differential amplifier 52 within an IVC driver 51. An output terminal of the differential amplifier 52 is connected to a gate of a driver-use PMOS transistor 54, whose source is connected to the external voltage source EVC and whose drain is connected with a non-inverting input terminal of the differential amplifier 52 and the internal circuit 56.

Therefore, when the operating mode of the internal voltage source generating circuit, having the construction of FIG. 1, is in the normal operating mode, (e.g., the first operating mode in which the control signal PDPDE and the complementary control signal PDPDEB are respectively determined as "low" and "high";) IVC is maintained as voltage (IVC=Normal) of a given level, as shown in 100 of FIG. 5.

A controller of a system on which a semiconductor memory device of is mounted (e.g., FIG. 1), converts the operating mode of the semiconductor memory device into a second operating mode, when the semiconductor memory device is not used (e.g., data stored in a DRAM maintained continuously). Thus, the operating mode is converted from the first operating mode to the second operating mode when the control signal PDPDE becomes "high" and the complementary control signal PDPDEB becomes "low". The PMOS transistors 12, 28 and the NMOS transistor 40 in FIG. 1 are turned Off by such mode conversion, and the PMOS transistors 32, 42 and NMOS transistors 24, 50 are turned On. Consequently, when converted into the second operating mode, the reference voltage generator 10 and the peripheral circuit reference voltage generator 26 in FIG. 1 are disabled so as not to operate. At this time, a voltage level of a first node (e.g., the voltage level of an output node of the peripheral circuit reference voltage generator 26) is determined by an operation of the internal voltage clamp 41, much lower than an output voltage level of the numerical equation 1 mentioned above. For example, it is determined as the voltage level of information capable of preserving CMOS logic. Such operation will become more definite in the following description.

When the PMOS transistor 42 and the NMOS transistor 50 are individually turned On, the EVC is supplied to a drain of an NMOS transistor 46 (diode-connected), through source and drain channels of the PMOS transistors 42, 44. Herewith, in a source of the NMOS transistor 46, a channel of an NMOS transistor 48 (diode-connected) and the driving-use transistor 50 is ground-connected. The driving-use transistor 50 is used for receiving the control signal PDPDE through a gate thereof. Thus, when the operating mode is the second operating mode, as determined by the outside command, the IVC generated in the IVC driver 51 is clamped at a level of the sum of threshold voltages (IVC=2Vt) provided in the two diodes 46, 48, as shown in 102 of FIG. 5.

As described above, when the operating mode is changed to the second operating mode, (e.g., the DPD mode) the operation in the reference voltage generator 10 and the peripheral circuit reference voltage generator 26 are disabled. In addition, the voltage level of the IVC is determined as a level for use for CMOS maintenance. This second mode operation will prevent not only a node within the internal circuit 56 from floating, but also surge current from rapidly flowing, and minimize leakage current of various voltage generators and transistors to minimize current consumption.

The above embodiment, was merely exemplary. The inventive IVC can also be used in supplying the internal voltages for circuits such as a memory array voltage, a boost voltage Vpp, a half voltage VCC and back bias voltage, etc. These uses would be accomplished by using the Vref in the same or similar application.

Figure 2:
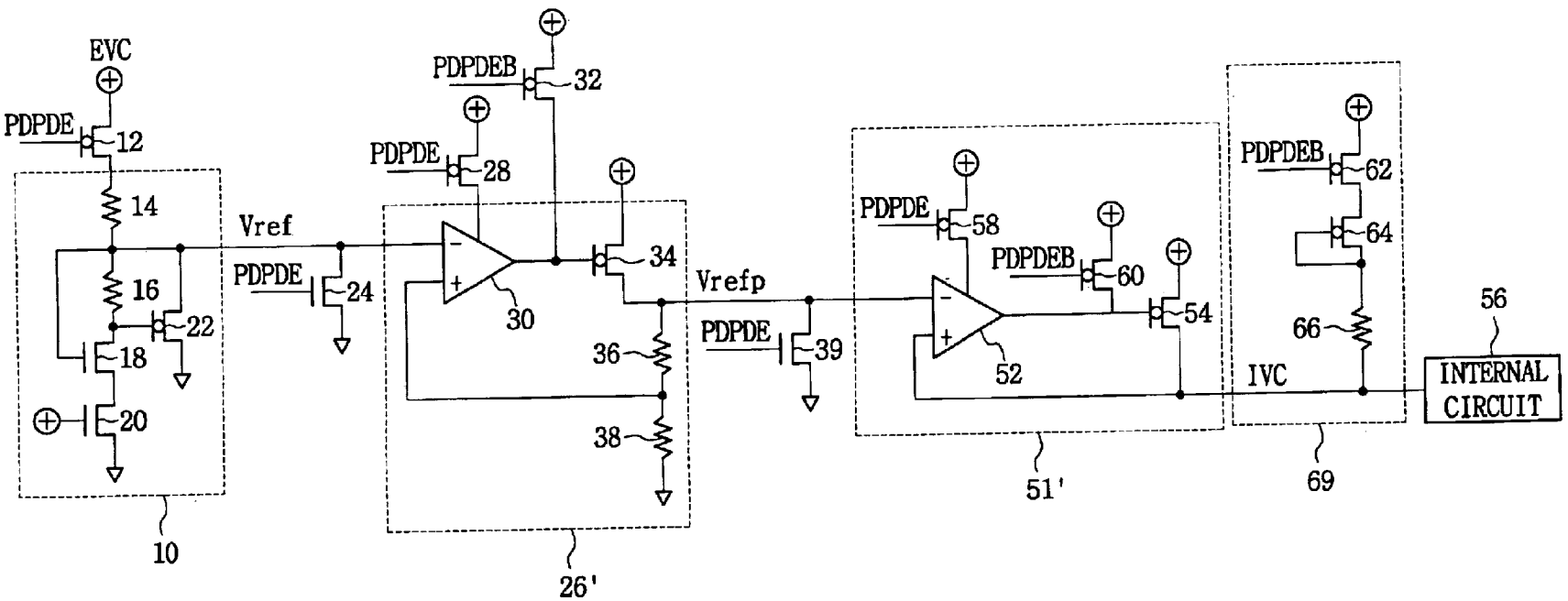
FIG. 2 represents a circuit diagram of a circuit for generating internal voltage source in a semiconductor memory device according to a second exemplary embodiment of the present invention.

FIG. 2 is a circuit diagram of a circuit for generating the IVC in the semiconductor memory device according to a second exemplary embodiment of the present invention. When the operating mode is changed from the first operating mode to the second operating mode, various interior voltage source generators 10, 26 and 51' are disabled, and a mode conversion IVC driver 69 is added for converting the EVC into the minimum IVC. With reference to FIG. 2, a PMOS transistor 58 is connected between the EVC and a voltage source supply terminal of the differential amplifier 52. A PMOS transistor 60 is connected between the EVC and an output terminal of the differential amplifier 52, within the above-mentioned internal voltage source driver 51'. The PMOS transistor 58 is utilized for receiving the control signal PDPDE through its gate and the PMOS transistor 60 is utilized for receiving the complementary control signal PDPDEB through its gate. An NMOS transistor 39 is connected for receiving the control signal PDPDE through a gate thereof, between an output terminal of the peripheral circuit reference voltage generator 26 and the ground. The mode conversion internal voltage source driver 69 is constructed by connecting a PMOS transistor 62 (switched by the complementary control signal PDPDEB), a PMOS transistor 64 (diode-connected) and a resistance 66 in series between the EVC and an input terminal of the internal circuit 56.

Figure 5:
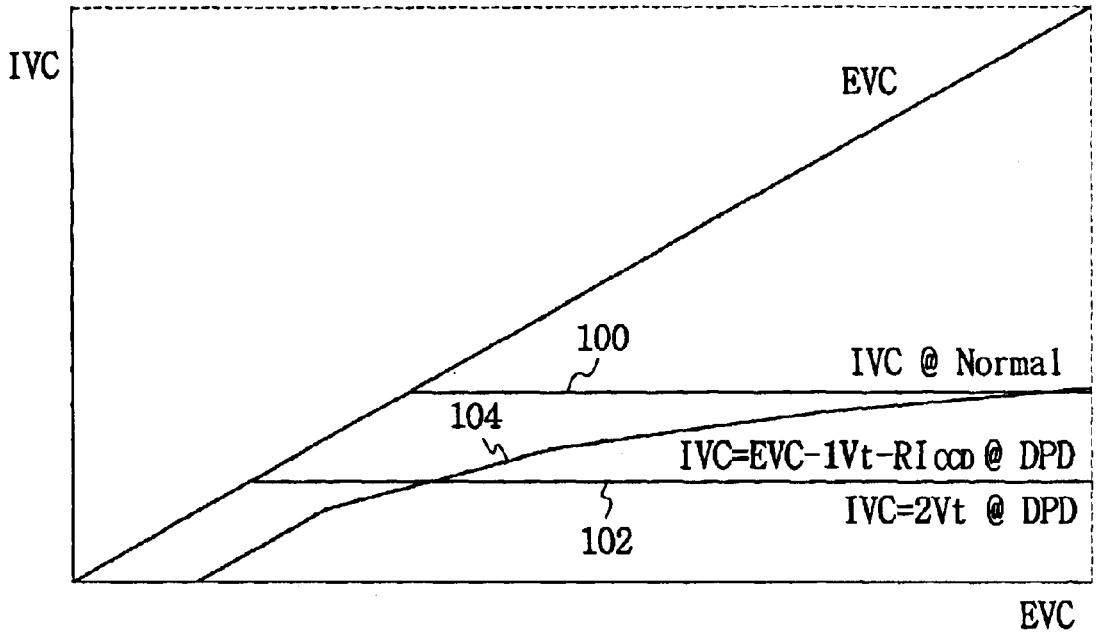
FIG. 5 is a characteristic diagram of internal voltage source versus external voltage source of the internal voltage source generating circuits shown in FIGS. 1 and 2.

When the internal voltage source generating circuit in the semiconductor memory device, as shown in FIG. 2, is determined to be in the first operating mode (wherein PDPDE=low and PDPDEB=high), the PMOS transistors 12, 28 and 58 are turned On, and the PMOS transistors 32, 60 and 62 are turned Off. The NMOS transistors 24, 39 are also turned Off. Note, internal voltage source diver 69 has no effect under the circuit when PMOS transistor 62 is off. Under such state, the circuit operates as described in FIG. 1, and the internal voltage source IVC(IVC=Normal), determined as shown in 100 of FIG. 5, is provided to the internal circuit 56.

If the input control signal PDPDE and the complementary control signal PDPDEB are respectively "high" and "low", so as to be transited to the second operating mode, the PMOS transistors 12, 28 and 58 are turned Off, and the PMOS transistors 32, 60 and 62 are turned On. Further, the NMOS transistors 24 and 39 are turned On. Thus, all the voltage generators 12, 26'and 51' are disabled, and only the mode conversion internal voltage source driver 69 is enabled, to supply the internal voltage source IVC=EVC−Vt−$RI_{CCD}$ to the internal circuit 56, the internal voltage source IVC=EVC−V−$RI_{CCD}$ being lowered from the external voltage source EVC by a voltage drop of the PMOS transistor 64 diode-connected and by a voltage drop ($R*I_{CCD}$) of a resistance 66. Herewith, $I_{CCD}$ indicates current consumed in an IVC node in the second operating mode, and when the EVC is increased, the IVC rises from the EVC like 104 of FIG. 5 in proportion to a voltage drop of diode.

Accordingly, in a circuit like FIG. 2, various interior voltage generators are disabled when the normal mode is transited to the DPD mode, to thus minimize the current consumption. The current consumption of the semiconductor memory device is minimized by supplying the IVC to the internal circuit, the IVC being determined as the minimum voltage level so as to maintain a minimum CMOS logic.

Figure 3:
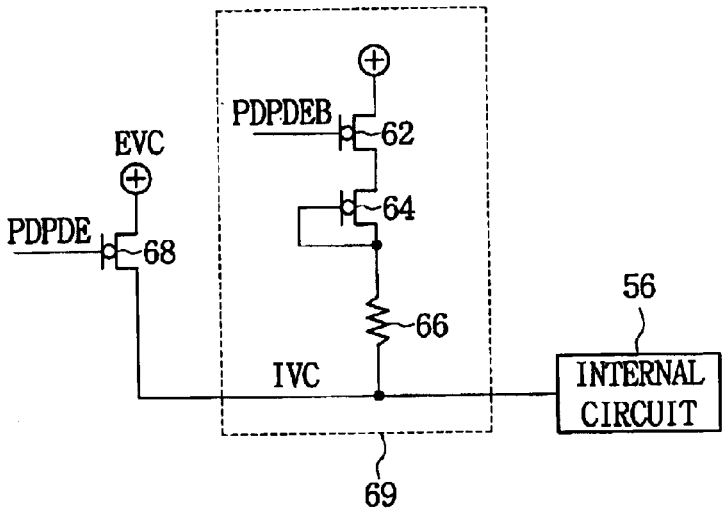
FIG. 3 illustrates a circuit diagram of a circuit for generating internal voltage source in a semiconductor memory device according to a third exemplary embodiment of the present invention.

FIG. 3 is a circuit diagram of a circuit for generating the internal voltage source in the semiconductor memory device according to a third exemplary embodiment of the present invention. The circuit in FIG. 3 is constructed to reduce the current consumption in the DPD mode and directly supply the EVC to the internal circuit 56, when operating in the normal mode.

Figure 6:
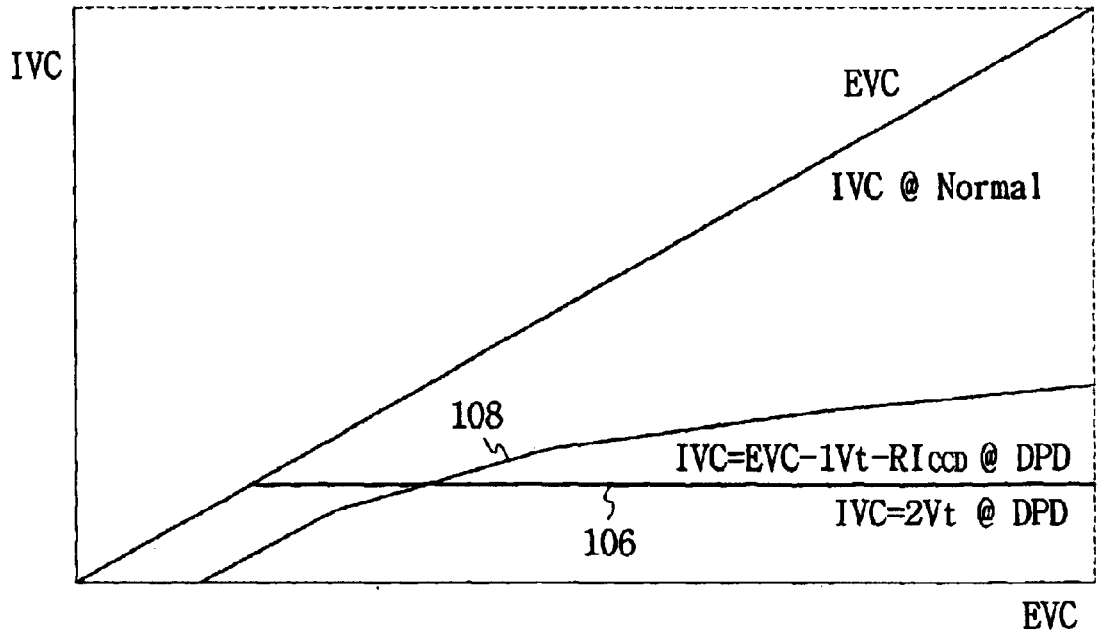
FIG. 6 is a characteristic diagram of internal voltage source versus external voltage source of the internal voltage source generating circuits shown of FIGS. 3 and 4.

In a case of the normal operating mode first operating mode, a PMOS transistor 68 has an input of the control signal PDPDE is "low", received through its gate and is turned On. The supply (EVC) is the operating voltage source of the internal circuit 56, as shown in FIG. 6, (EVC=IVC). At this time, the PMOS transistor 62, having an input of the complementary control signal PDPDEB through its gate, is turned Off to thus disable the mode conversion internal voltage source driver 69.

If the circuit in FIG. 3 is in a low power consumption operation mode (e.g., the first operating mode is transited to the second operating mode), the EVC "normally" provided to the internal circuit 56 is interrupted. In the second supporting mode, control signal PDPDE is "high" and the complementary control signal PDPDEB is "low"; thus the mode conversion internal voltage source driver 69 is enabled by a turn-on of the PMOS transistor 62. When the mode conversion internal voltage source driver 69 is enabled, the IVC is at a level of "EVC−Vt−$RI_{CCD}$" and supplied to the internal circuit 56.

Figure 4:
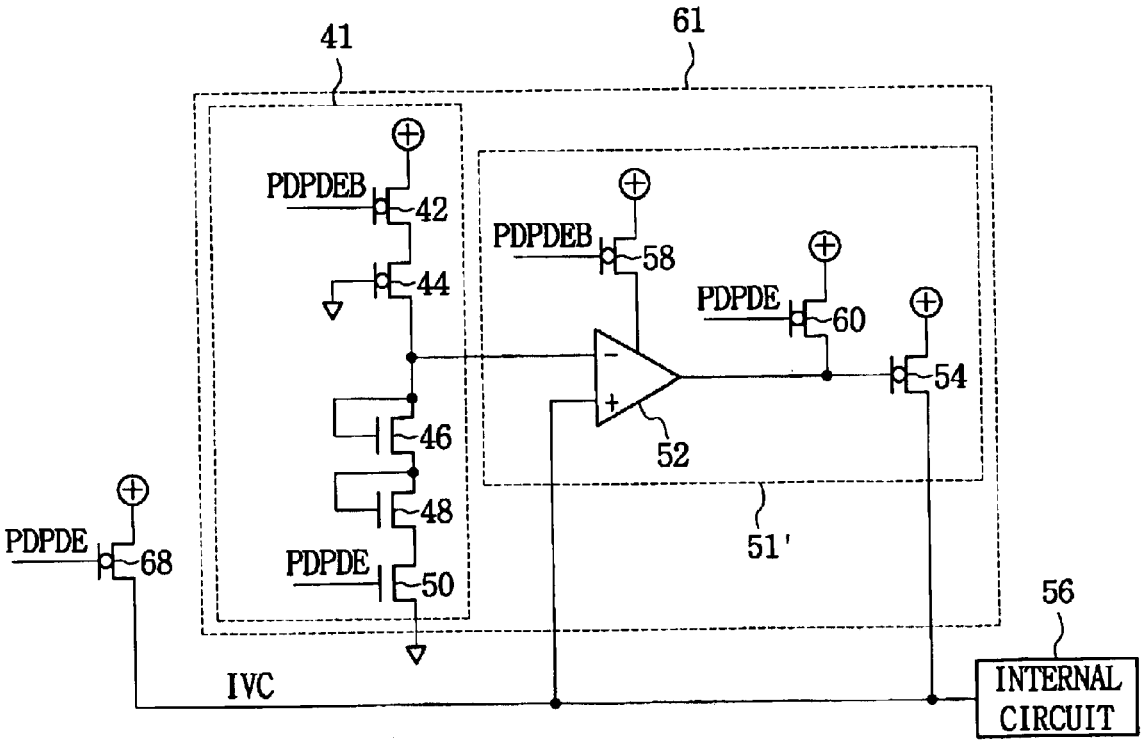
FIG. 4 sets forth a circuit diagram of a circuit for generating internal voltage source in a semiconductor memory device according to a fourth exemplary embodiment of the present invention.

FIG. 4 is a circuit diagram of a circuit for generating the internal voltage source in the semiconductor memory device according to still another exemplary embodiment of the present invention. FIG. 4 is constructed such that in the normal operating mode (e.g., the first operating mode), the PMOS transistors 68, 60, having an input of the control signal PDPDE of "low" through its gates, are turned On. Thus, the supply of the EVC is the operating voltage source of the internal circuit 56, as shown in FIG. 6, (EVC=IVC). At this time, the PMOS transistor 42, 58, having an input of the complementary control signal PDPDEB through its gates, are turned Off and the mode conversion internal voltage source generator 61 is disabled. The mode conversion internal voltage source generator 61 shown in FIG. 4, is constructed with the internal voltage clamp 41 as shown in FIG. 1 and the internal voltage source driver 51' as shown in FIG. 2.

If the circuit is operating in the DPD mode, (e.g., the first operating mode is transited to the second operating mode), the EVC provided to the internal circuit 56 is cut off. The control signal PDPDE of "high" and the complementary control signal PDPDEB of "low"; thus, the PMOS transistors 42, 58 and the NMOS transistor 50 are turned On and the PMOS transistor 60 is turned Off to enable the mode conversion internal voltage source generator 61. When the mode conversion internal voltage source generator 61 is enabled, the IVC, determined as a level of "2Vt" as shown in 106 of FIG. 6, is supplied to the internal circuit 56.

As afore-mentioned, in accordance with the present invention, when a semiconductor memory device operates in DPD mode, due to a control signal provided from the outside, a first level of the external voltage source is prevented from reaching the internal circuit simultaneously, and the IVC of a different voltage level is provided to prevent internal nodes from floating and maintain a voltage level of minimizing a current consumption.

It will be apparent to those skilled in the art that various modifications and variations can be made in the present invention without deviating from the spirit or scope of the invention. Thus, it is intended that the present invention cover the modifications and variations of this invention, within the scope of the appended claims and their equivalents. For instances, in a different case, it is of course, valid to change the detailed structure to various types of circuit.

What is claimed is:

1. A semiconductor memory device, comprising:

an internal voltage generating circuit operable to generate a first voltage in a normal operating mode and a second voltage in a power down operating mode, the internal voltage generating circuit generating the first and second voltages from a source voltage.

2. The device of claim 1, further comprising:

an internal circuit operating based on a voltage supplied by the internal voltage generating circuit.

3. The device of claim 1, wherein the internal voltage generating circuit receives a control signal indicating the operating mode.

4. The device of claim 3, further comprising:

a pin receiving the control signal.

5. The device of claim 1, wherein the internal voltage generating circuit converts an external source voltage down to generate the first voltage and second voltages.

6. The device of claim 1, wherein the internal voltage generating circuit supplies an external source voltage as the first voltage and converts the external voltage down to generate the second voltage.

7. A semiconductor memory device, comprising:

a first voltage generating circuitry operable to down convert a source voltage to a first voltage in a first operation mode, the first voltage generating circuitry includes, a reference voltage generator generating a reference voltage based on the source voltage;

a peripheral circuit reference voltage generator generating a peripheral reference voltage based on the reference voltage;

a driving circuit generating the first voltage based on the peripheral reference voltage; and a second voltage generating circuit operable to convert the source voltage to a second voltage in a second operation mode, the second voltage being less than the first voltage.

8. The device of claim 7, wherein the reference voltage generator includes a voltage divider.

9. The device of claim 7, wherein the peripheral circuit reference voltage generator includes a differential amplifier.

10. The device of claim 7, wherein the driving circuit includes a differential amplifier.

11. The device of claim 7, wherein the second voltage generating circuit comprises:

a switch connected to the source voltage;

at least one diode connected in series with the switch; and a resistance connected in series with the at least one diode.

12. The device of claim 11, wherein the switch operates based on a control signal indicating whether an operating mode is the first operating mode or the second operating mode.

13. The device of claim 11, wherein the at least one diode is a NMOS transistor and a gate of the NMOS transistor is connected to a source of the NMOS transistor.

14. The device of claim 7, wherein the first voltage generating circuit further comprises:

disabling circuitry operable to disable the reference voltage generator, the peripheral circuit reference voltage generator, and the driving circuit during the second operating mode.

15. The device of claim 7, wherein the first operating mode is a normal operating mode and the second operating mode is deep power down operating mode.

16. A method of voltage regulation for a semiconductor memory device, the method comprising:

first generating, from a source voltage, a first voltage level in a normal operating mode of the semiconductor memory device; and second generating, from the source voltage, a second voltage level in a power down operating mode of the semiconductor memory device.

17. The method of claim 16, wherein the first generating step generates the first voltage by down converting a source voltage, and the second generating step generates the second voltage by down converting the source voltage, the second voltage being less than the first voltage.

18. The method of claim 16 wherein the first generating step generates the first voltage by supplying a source voltage as the first voltage, and the second generating step generates the second voltage by down converting the source voltage, the second voltage being less than the first voltage.

19. A semiconductor memory device, comprising:

an internal voltage generating circuit including, a first voltage generating circuit activated by a selection signal indicating a first mode such that the internal voltage generating circuit generates a first voltage, and the first voltage generating circuit being deactivated by the selection signal indicating a second mode, and a second voltage generating circuit connected to the first voltage generating circuit and activated by the selection signal indicating the second mode such that the internal voltage generating circuit generates a second voltage, the second voltage being less than the first voltage.

20. The device of claim 19, wherein the first voltage generating circuit converts an external source voltage down to generate the first voltage.

21. The device of claim 19, wherein the first voltage generating circuit supplies an external source voltage as the first voltage.

22. The device of claim 19, wherein the first voltage generating circuit comprises:

a driving circuit generating the first voltage based on a reference voltage and the selection signal.

23. The device of claim 22, wherein the second voltage generating circuit applies a voltage to the driving circuit when the selection signal indicates the second mode such that the driving circuit generates the second voltage.

24. The device of claim 19, the second voltage generating circuit includes a driving circuit generating the second voltage when the selection signal indicates the second mode.

* * * * *